United States Patent [19]

Würthner

[11] 4,020,951

[45] May 3, 1977

[54] ARRANGEMENT FOR RELEASABLY SUSPENDING A SHEET MEMBER FROM A SUPPORT

[75] Inventor: Roland Würthner, Stuttgart-Hedelfingen, Germany

[73] Assignee: Louis Leitz, Stuttgart, Germany

[22] Filed: Apr. 29, 1976

[21] Appl. No.: 681,554

[30] Foreign Application Priority Data

May 2, 1975 Germany ..... 2519549

[52] U.S. Cl. ..... 211/46; 211/113; 248/222.1

[51] Int. Cl.[2] ..... B42F 15/04

[58] Field of Search ..... 248/359, 360, 223, 224; 211/113, 126, 46; 312/184

[56] References Cited

UNITED STATES PATENTS

| | | | |
|---|---|---|---|
| 1,832,239 | 11/1931 | Pedersen | 312/184 |
| 3,359,986 | 12/1967 | Koenders | 211/46 |
| 3,398,839 | 8/1968 | Ballenger | 211/113 |
| 3,923,353 | 12/1975 | Elias et al. | 312/184 |

FOREIGN PATENTS OR APPLICATIONS

| | | | |
|---|---|---|---|
| 256,785 | 9/1967 | Austria | 312/184 |
| 547,860 | 6/1956 | Belgium | 312/184 |
| 1,032,526 | 7/1953 | France | 312/184 |
| 2,030,381 | 1/1971 | Germany | 312/184 |
| 286,978 | 3/1928 | United Kingdom | 312/184 |

*Primary Examiner*—Marion Parson, Jr.
*Attorney, Agent, or Firm*—Hans Berman

[57] ABSTRACT

In an arrangement for suspending a sheet member of a file folder or the like from a supporting rail having two longitudinal beads received in respective edge notches of the sheet member, the open side of one notch is normally obstructed by a unitary latch body movably secured to the edge portion of the sheet. Two bracket portions of the latch body receive the edge portion between respective opposite faces, a spring portion abuttingly engages the edge portion of the sheet member and biases the latch body toward an operative position in which a detent portion of the same obstructs the open side of the one notch.

14 Claims, 7 Drawing Figures

ARRANGEMENT FOR RELEASABLY SUSPENDING A SHEET MEMBER FROM A SUPPORT

This invention relates to an arrangement for releasably suspending a sheet member from a support, and more particularly to a latching device for obstructing the open side of one of two notches in the edge portion of a sheet member and for thereby retaining a portion of a support in the obstructed notch.

The invention will be described hereinafter with specific reference to a known filing system in which file folders are suspended from a supporting rail in a file cabinet by engagement of rail portions in notches formed in the free edge of a sheet member of the folder. Each file folder may be removed from the rail by shifting a latching device on the file folder away from its operative position against the restraint of a spring, the latching device in its operative position obstructing an otherwise open side of one of the notches and thereby retaining a rail portion in the notch.

The known latching devices are relatively complex and correspondingly costly, and, therefore, the aforedescribed filing system has not found the wide application that its other advantages would deserve. It is a primary object of this invention to provide an arrangement for releasably suspending a sheet member, such as a file folder, from a support in the manner described with a latching device which is inexpensive to make and to attach to a sheet member, not necessarily a file folder.

With this object and others in view, as will hereinafter become apparent, the improved latching device of the invention comprises a unitary latch body secured to an edge portion of the sheet member to be suspended for movement toward and away from an operative position. The latch body has two bracket portions, a detent portion, and a spring portion. The bracket portions receive the sheet member between respective opposite faces thereof in movable engagement. The detent portion connects the bracket portions and partly obstructs the open side of a notch in the edge portion of the sheet member in the operative position of the latch body. The spring portion abuttingly engages the edge portion of the sheet member and biases the latch body toward its operative position.

Other features, additional objects, and many of the attendant advantages of this invention will readily be appreciated as the same becomes better understood by reference to the following detailed description of preferred embodiments when considered in connection with the appended drawing in which.

Figure 1:
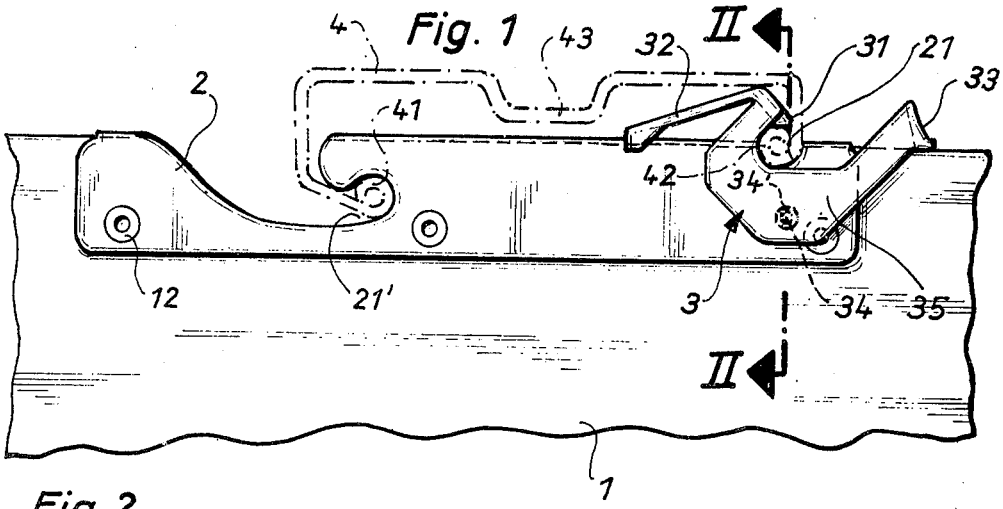
FIG. 1 shows a file folder suspending arrangement of the invention in fragmentary side elevation.
Figure 5:
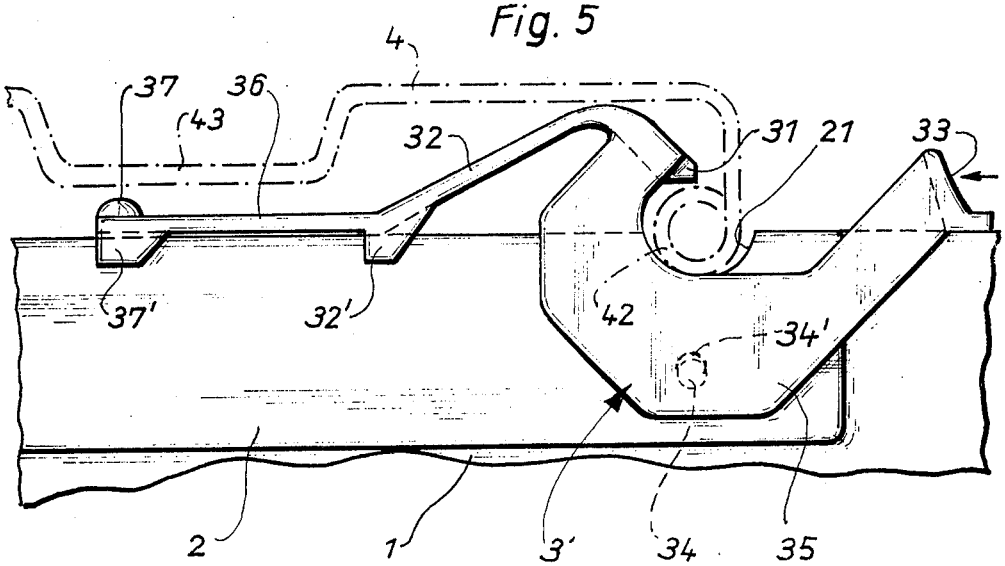
Figure 6:
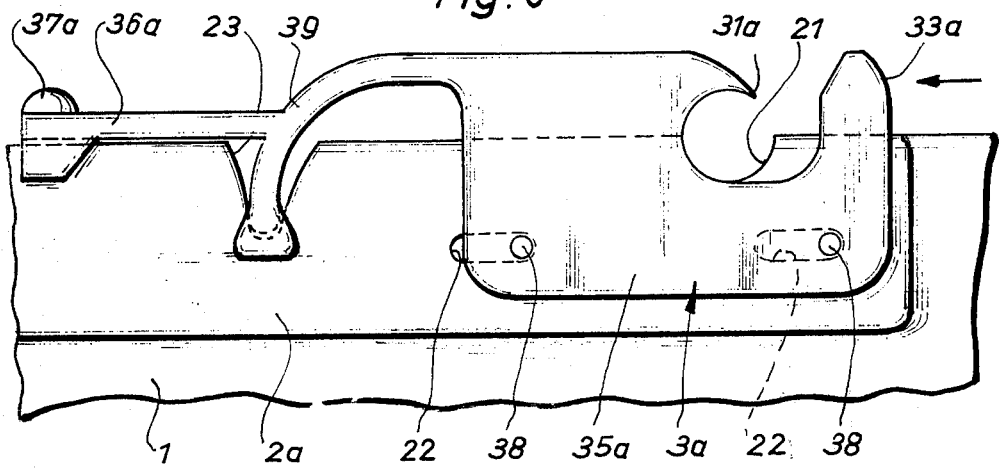
Figure 7:
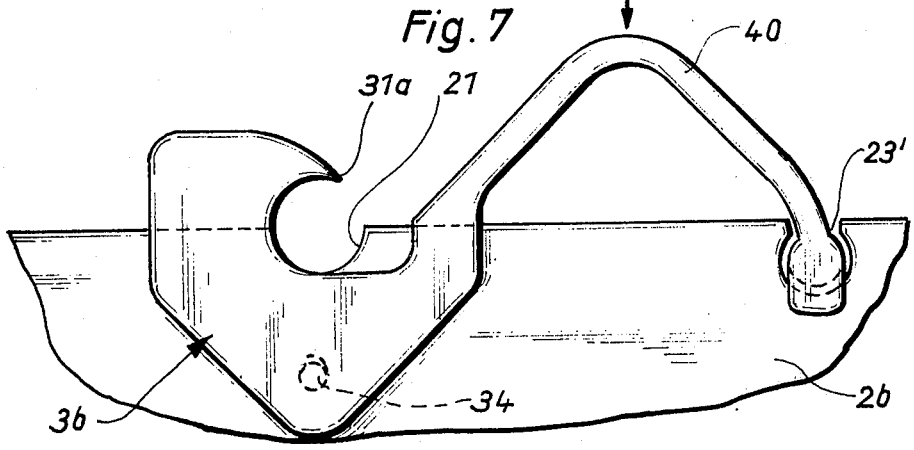

FIGS. 5, 6, and 7 illustrate other suspending arrangements of the invention in respective views corresponding to that of FIG. 1.

Referring now to the drawing in detail, and initially to FIGS. 1 to 4, there is seen only as much of a basically conventional file folder 1 as is needed for an understanding of the invention. The body of the folder is a sheet of cardboard folded approximately in half, only the folded, elongated edge portion being seen in the drawing. It is reinforced by a cardboard spacer 11 between the two cardboard layers of the edge portion and by rivets 12 which secure sheet metal reinforcement 2 to the edge portion of the folder 1 and to the spacer 11. Clamps on the portions of the folder 1 not seen in the drawing permit papers to be fastened in the folder in a conventional manner not directly relevant to this invention.

The reinforcement 2 is approximately U-shaped in cross section and tightly clamps the edge portion of the folder 1 between its two flanges. Two notches 21, 21′ extend inward of the bight of the molding 2, and corresponding cutouts are formed in the edge portion of the cardboard of the folder 1. The notch 21 is approximately semi-cylindrical about an axis perpendicular to the direction of the edge portion and to the planes defined by the main surfaces of the folder 1. The notch 21′ is undercut under an integral hook 24 of the sheet metal reinforcement.

The file folder 1 is one of many identical folders capable of being suspended from a supporting rail 4 shown in FIG. 1 in cross-sectional phantom view. The longitudinal edges of the rail 4 are shaped to constitute beads 41, 42. The central portion 43 of the rail 4 is offset from the otherwise planar body of the rail 4 in a common transverse direction with the beads 41, 42. The bead 41 is retained in the notch 21′ by the hook 24, and the bead 42 is retained in the notch 21 by a fastening device 3 with which this invention is more specifically concerned.

Figure 3:
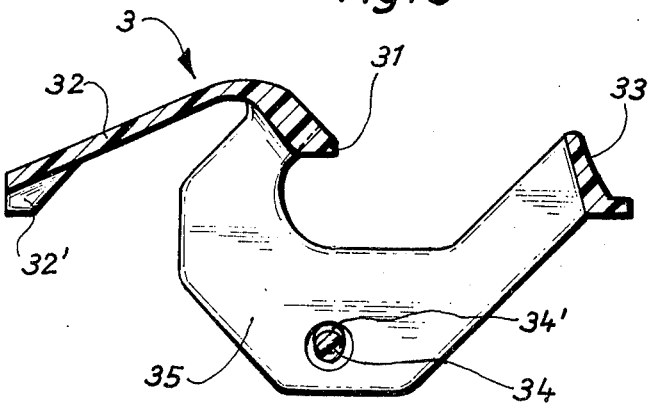
FIG. 3 is a side elevational view of a latch body in the device of FIG. 2 in section on the line III — III of FIG. 2 on a scale intermediate the scales of FIGS. 1 and 2.

The fastening device basically consists of a unitary molding of plastic or synthetic resin composition most portions of which are symmetrical relative to a plane parallel and adjacent to the plane of FIG. 3.

The plastic molding, hereinafter referred to as the unitary latch body 3, includes two flat, identical brackets 35 which are angle levers fulcrumed in the reinforcement 2 and the edge portion of the folder 1 by means of a pivot pin 34. The two arms of the brackets 35 are oppositely offset from the pin 34 in the direction of elongation of the illustrated edge portion of the folder 1. The terminal parts of corresponding first arms of the brackets 35 are integrally connected by a detent 31 while the terminal parts of the second arms are connected by a manually operable releasing element 33. An elongated arm portion of the latch body 3 constitutes a spring 32 which extends from the detent 31 in a direction away from the element 33. Its end remote from the detent 31 carries two spacedly parallel, transverse flanges 32′.

Figure 2:
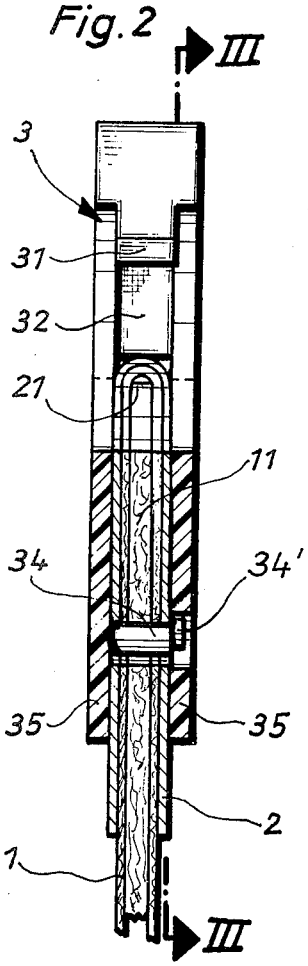
FIG. 2 illustrates the device of FIG. 1 in enlarged section of the line II — II.
Figure 4:
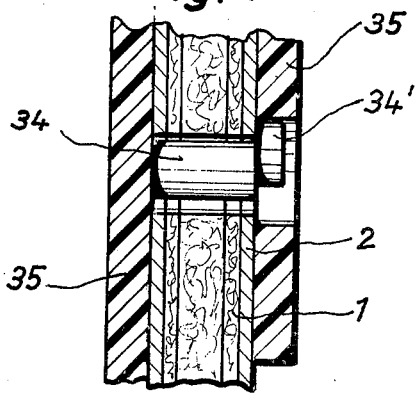
FIG. 4 is an enlarged detail view of a portion of FIG. 2.

As is better seen in FIGS. 2 and 4, the pivot pin 34 is integral with one of the brackets 35 and extends through aligned openings in the metal reinforcement 2, the cardboard body of the file folder 1, the filler 11, and the other bracket 35. The openings are radially oversized relative to the pin 34 so as to permit a transversely offset locking head 34′ of the pin to be passed manually through the aligned openings. When the folder 1 is suspended for the first time from the rail 4, the latch body 3 is shifted by the retained bead 42 into the position illustrated in the drawing in which the head 34′ prevents the pin 34 from being withdrawn.

Referring to FIG. 1, the exposed edge of the reinforcement 2 and the obscured edge of the folder 1 are received between the flanges 32′ of the spring 32, the free end of the spring abutting against the edge of the reinforcement 2 under its resilient tension, but being longitudinally slidable on the edge. The releasing element 33 abuts against the edge of the reinforcement 2 under the resilient tension of the spring 32. The spring holds the detent 31 in an operative position in which it prevents release of the bead 42 from the notch 21.

As is not explicitly shown in the drawing, the surface of the element 33 obliquely directed toward the right in FIG. 1 is knurled. It faces outward of the non-illustrated file cabinet so that the releasing element 33 may be grasped by one finger while the other fingers of the same hand grasp the file folder 1. The latch body 3 is swung counterclockwise on the pivot pin 34 by means of the element 33, thereby withdrawing the detent 31 from the open side of the notch 21. The file folder may next be pivoted downward about the bead 41 until the bead 42 clears the latch body 3. A short rearward movement of the file folder in the file cabinet next releases the bead 41 from the hook 24, and the file folder may be removed through the open side of the non-illustrated cabinet.

To suspend the folder from the rail 4, the bead 41 is first engaged in the notch 21', and the file folder thereafter is swung upward until the bead 42 strikes the obliquely sloping top surface of the detent 31. The resulting resilient deformation of the spring 32 causes the brackets 35 to swing counter clockwise from the position illustrated in FIG. 1 so that the releasing element 33 is lifted from the edge of the reinforcement 2, and the bead 42 can enter the notch 21. The spring 32 thereafter returns the latch body 3 to the illustrated condition.

The latch body 3' illustrated in FIG. 5 is identical with the afore-described plastic body 3 except for an elongated extension arm 36 which extends from the free end of the spring 32 in a direction longitudinal of the file folder edge away from the brackets 35. At its end remote from the spring 31, the extension arm 36 carries an approximately hemispherical abutment 37 and flanges 37' integrally molded with the other portions of the latch body 3'.

The flanges 32', 37' laterally secure the associated ends of the spring 32 and of the extension arm 36 relative to the edges of the reinforcement 2 and of the cardboard file 1. The abutment 37 is located adjacent the offset portion 43 of the rail 4 and prevents or at least impedes a pivotal movement of the spring 32 which could release the flanges 32'.

In the embodiment of the invention shown in FIG. 6, a unitary, plastic latch body 3*a* has two flat brackets 35*a* of which only one is seen in the drawing. In a manner analogous to the showing of FIGS. 2 to 4, respective parts of the brackets 35*a* which are spaced longitudinally of the edge portion of an associated file folder 1 are connected transversely to the plane of FIG. 6 by an integral releasing element 33*a* and a detent 31*a*. A slender, and therefore resilient, spring arm 39 extends in an arc of about 90° from the detent 31*a* into a notch 23 located in the edge of the reinforcement between the notch 21 and the notch 21', not itself visible in FIGS. 5 to 7.

Two slots 22 in the reinforcement 2 and corresponding openings, not shown in the file folder 1 are elongated parallel to the direction of elongation of the illustrated edge portions of the file folder and the reinforcement and the longitudinally aligned. Guide pins 38 project integrally from one of the brackets 35*a* through the slots 22 into respective conforming openings of the other bracket 35*a* so as to guide the latch body 3 from the illustrated, operative position of the detent 31*a* into a releasing position when manual pressure applied to the element 33*a* in the direction indicated by an arrow causes the latch body to slide against the resilient restraint of the spring 39 which is being flexed. An extension arm 36*a* on the spring 39 and an abutment 37*a* on the free end of the extension arm prevent the free end of the spring 39 from escaping the notch 23. The bead 42, when striking the obliquely inclined top face of the detent 31*a*, similarly causes displacement of the latch body 3*a*, and is locked in the notch 21 when the latch body 3 is returned to the illustrated position by the spring 39.

The latch body 3*b* illustrated in FIG. 7 has two brackets mounted on a pivot pin 34 as described with reference to FIGS. 1 to 4. They are connected at one end by a detent 31*a* identical with the detent shown in FIG. 6, and at the other end by a spring arm 40 whose two longitudinal parts are joined at right angles. The free end of the arm 40 is received in a notch 23' of the reinforcement 2*b* which is offset from the controlled notch 21 in a direction away from the non-illustrated notch 21'. The spring arm 40 biases the latch body 3*b* toward the illustrated operative position, but causes release of the detent 31*a* when manual pressure is applied thereto in a direction indicated by an arrow.

It is a common feature of the several latching devices of the invention described hereinabove that their plastic latch bodies can be assembled with a sheet member without the use of tools. When the bracket portions are spread manually sufficiently, a sheet member or its reinforcement may be moved into the space between the pivot pin or guide pin on one bracket and the inner face of the other bracket until the pivot or guide pin is aligned with a corresponding aperture in the edge portion, and can be inserted. The resiliency of the plastic material then holds the latch body in position.

Other modifications of the file folder suspension system of the invention will readily suggest themselves to those skilled in the art on the basis of the above teachings. The suspension system, of course, is useful not only for file folders, but also for other sheet members, such as fabric samples, maps, pockets and bags for various purposes, and the like. The illustrated metal reinforcement is a necessary part of each file folder when the latter is made of relatively weak cardboard, but may be dispensed with if the suspended sheet member is sufficiently strong. For the purpose of this disclosure, the reinforcement is a part of the sheet member to be suspended and constitutes much of the edge portion of the latter.

It should be understood, therefore, that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. In an arrangement for suspending a sheet member from a support, the sheet member having a substantially planar, elongated edge portion formed with two spaced notches for engagement by respective portions of said support, one of said notches being open transversely to the direction of elongation of said edge portion, the sheet member carrying a latching device for partly obstructing the open side of said one notch and for thereby retaining a portion of support in said one notch, the improvement in the latching device which comprises: a unitary latch body secured to said edge portion for movement toward and away from an operative position, said latch body including 1. two bracket portions having respective opposite faces and receiving said sheet member between said faces in movable engagement,
2. a detent portion connecting said bracket portions and partly obstructing said open side in said operative position of said latch body,
3. a spring portion abuttingly engaging the edge portion of said sheet member and biasing the latch body toward said operative position thereof.

2. In an arrangement as set forth in claim 1, a pivot pin connecting one of said bracket portions to said sheet member for pivoting movement of said latch body and away from said operative position about an axis transverse to said faces.

3. In an arrangement as set forth in claim 1, cooperating guide means on said edge portion and on one of said bracket portions for guiding movement of said latch body in said direction of elongation toward and away from said operative position.

4. In an arrangement as set forth in claim 1, said bracket portions having each first and second terminal parts spaced in said direction of elongation, said detent portion connecting the first terminal parts of said bracket portions, and said spring portion being elongated in said direction and extending from said detent portion away from said bracket portions.

5. In an arrangement as set forth in claim 4, said spring portion having a free end remote from said detent portion abutting against said edge portion transversely to said direction of elongation and being movable in said direction relative to the engaged edge portion.

6. In an arrangement as set forth in claim 4, said edge portion being formed with a third notch spaced from each of said two notches, said spring portion having a free end remote from said detent portion and received in said third notch.

7. In an arrangement as set forth in claim 4, said spring portion having a free end remote from said detent portion and engaging said edge portion, said latch body further including an extension portion directly connected to said free end and elongated in said direction from said free end away from said detent portion, said extension portion carrying an integral, transverse abutment spaced from said free end and directed away from said edge portion.

8. In an arrangement as set forth in claim 1, said latch body consisting essentially of synthetic resin composition.

9. In an arrangement as set forth in claim 1, said latch body further including a guide portion projecting from one of said bracket portions through an opening in said sheet member, the other bracket portion being formed with an aperture receiving said guide portion.

10. In an arrangement as set forth in claim 9, locking means on said guide portion remote from said one bracket portion for preventing withdrawal of said guide portion from said opening.

11. In an arrangement as set forth in claim 1, said bracket portions having each first and second terminal parts spaced in said direction of elongation, said detent portion connecting the first terminal parts, said latch body including releasing means connecting the second terminal parts and manually operable for moving said latch body away from said operative position.

12. In an arrangement as set forth in claim 11, said spring portion being secured to one of said parts of each bracket portion and being elongated in a direction away from said bracket portions, said spring portion having a free end remote from said bracket portions and abuttingly engaging said edge portion, two flanges being integrally joined to said free end and projecting from the same transversely to said direction of elongation, said flanges receiving said edge portion therebetween.

13. In an arrangement as set forth in claim 1, said bracket portions having each first and second terminal parts spaced in said direction of elongation, said detent portion connecting the first terminal parts of said bracket portions, and said spring portion connecting the second terminal parts and extending therefrom in said direction of elongation away from said bracket portions.

14. In an arrangement as set forth in claim 13, said edge portion being formed with a third notch spaced from said two notches, said spring portion having a free end remote from said bracket portions and received in said third notch.

* * * * *